US008079320B1

(12) United States Patent
Suriani

(10) Patent No.: US 8,079,320 B1
(45) Date of Patent: Dec. 20, 2011

(54) PERIMETER FRAME SYSTEM FOR USE WITH CONSTRUCTION BARGES

(75) Inventor: Brian J. Suriani, Fort Wayne, IN (US)

(73) Assignee: Mid-America Foundation Supply Inc., Fort Wayne, IN (US)

( * ) Notice: Subject to any disclaimer, the term of this patent is extended or adjusted under 35 U.S.C. 154(b) by 65 days.

(21) Appl. No.: 12/611,402

(22) Filed: Nov. 3, 2009

(51) Int. Cl.
*B63B 35/28* (2006.01)

(52) U.S. Cl. ..... 114/26; 114/263

(58) Field of Classification Search ..... 114/26, 114/263
See application file for complete search history.

(56) References Cited

U.S. PATENT DOCUMENTS 4,011,826 A * 3/1977 Yee ..... 114/65 A
5,613,339 A * 3/1997 Pollock ..... 52/836
2009/0283025 A1* 11/2009 Bigler et al. ..... 114/263

OTHER PUBLICATIONS

Poseidon Barge Corporation Brochure, prior to Nov. 3, 2008.

* cited by examiner

*Primary Examiner* — Stephen Avila
(74) *Attorney, Agent, or Firm* — Baker & Daniels LLP

(57) ABSTRACT

The present invention provides a perimeter frame system for use in forming the top and/or bottom surface of a construction barge. In one exemplary embodiment, the perimeter frame system is used in conjunction with support panels that are manufactured from extruded or roll form materials, such as extruded aluminum or roll form steel. The use of the perimeter frame system of the present invention eliminates the need to modify the perimeter edge portions of the extrusions forming the deck of the barge.

12 Claims, 11 Drawing Sheets

PERIMETER FRAME SYSTEM FOR USE WITH CONSTRUCTION BARGES

BACKGROUND

1. Field of the Invention

The present invention relates to barges and particularly to barges for supporting construction equipment in open water.

2. Description of the Related Art

Barges are commonly used to support construction equipment, such as cranes, in open water during construction projects in or near inland rivers or lakes, for example. Due to the weight of the equipment supported by the barge, mats and/or other rigid support structures may be positioned atop the deck of the barge to facilitate the distribution of the weight of the construction equipment across the entirety of the deck of the barge. This allows for a barge to support an increased amount of weight, such that the construction barge may support large cranes, without causing permanent deformation of the deck of the barge.

In order to form the deck of a barge that will be used in conjunction with construction equipment, individual metal plates are welded together. For example, in a known barge design, individual metal plates that are approximately one-quarter of an inch thick are welded to one another. Once welded together, the plates form a panel that is sized to extend between opposing side walls and end walls of the barge. If modifications to the plates are necessary to accommodate the specific design of a particular side wall or end wall of the barge, material may be removed from the plates using a torch or plasma cutter. The plates are then connected directly to the side and end walls of the barge, such as by welding. The plates are also connected to internal support structures that are formed within the barge and that extend between opposing top and bottom sides of the barge. The process of forming the deck of the barge is then repeated to form the bottom surface of the barge. This results in the formation of a watertight structure having a continuous top and bottom surface.

In order to increase the strength of the deck of a barge, extruded or roll form products may be used. Such products are commercially available from Roll Form Group of Mississauga, Ontario. However, extruded or roll form products often have complex cross-sectional shapes, varying thicknesses, and/or layers that are spaced apart from one another. For example, extruded or roll form products may be elongate and form tubular channels that make modification of the product difficult. When used for a deck of a barge, the modification of the edges of the extruded or roll form product, such as by plasma cutting or machining, which is necessary to match the edges of the extruded or roll form product to the exterior of the barge in order to form a watertight seal, is difficult. As a result, forming a deck of a barge from extruded or roll form product is both time consuming and expensive.

SUMMARY

The present invention provides a perimeter frame system for use in forming the top and/or bottom surface of a construction barge. In one exemplary embodiment, the perimeter frame system is used in conjunction with support panels that are manufactured from extruded or roll form materials, such as extruded aluminum or roll form steel. The use of the perimeter frame system of the present invention eliminates the need to modify the perimeter edge portions of the extrusions forming the deck of the barge.

Specifically, unlike traditional construction barges in which the outer edges of the metal sheets forming the deck are modified to accommodate components positioned at or along a perimeter edge of the barge, the deck of the barge of the present invention are left unmodified. Instead, only the perimeter frame system is modified. By forming the perimeter frame system from elements and in a manner that allows the perimeter frame system to be more easily modified, the cost of manufacturing and assembling a barge incorporating the teachings of the present invention is decreased. Additionally, a watertight seal may be easily formed with the perimeter of the barge, as described in detail below.

The outer perimeter of a construction barge has a substantially rectilinear configuration that may include deviations, such as recesses, that provide space for the receipt of necessary components. Specifically, recesses may be formed in the side walls of a barge to accommodate connectors for connecting adjacent barges to one another, such as Rendrag® type connector components. "Rendrag" is a registered trademark of Rendrag Incorporated of Sealy, Tex. Additionally, cable thimbles may be formed along the perimeter edges of the barge that define channels sized to receive sections of cable therethrough. The formation of recesses and cable thimbles along the perimeter edge of the barge requires modification of the material adjacent to the perimeter edge. As indicated above, instead of modifying the material forming the deck, the perimeter frame system of the present invention may be modified.

Specifically, the perimeter frame system of the present invention is designed to provide a connection between the exterior perimeter of the barge and the deck of the barge. For example, a plurality of individual perimeter frame segments may be positioned within a gap formed between the perimeter of the barge and a deck of the barge. The individual perimeter frame segments may be formed from a material having a thickness that is less than the thickness of the material forming the deck. Further, the individual perimeter frame segments may be formed from a single layer of material. As a result, the perimeter frame segments may be more easily modified to match the perimeter of the barge and more readily secured to the perimeter of the barge in a watertight manner.

In one form thereof, the present invention provides a barge for supporting construction equipment in a body of water. The barge includes a body having a rectilinear configuration with two substantially vertical parallel side walls and two substantially vertical parallel end walls. The side walls and the end walls cooperate to define a body perimeter having a body area. The body has a top support structure at least partially defining a top surface of the body forming a deck of the barge and a bottom support structure at least partially defining a bottom surface of the body forming a bottom of the barge. The top support structure includes a plurality of elongate sections secured to one another to form a panel. Each of the elongate sections includes at least one tubular channel and has a first layer and a second layer. The second layer extends in a direction substantially parallel to the first layer and is spaced from the first layer, wherein a gap is defined between the first layer and the second layer. The panel defines a panel perimeter having a panel area. The panel area is less than the body area, wherein the panel is positioned within the body perimeter and a perimeter gap is formed between the panel perimeter and the body perimeter. The top support structure also includes a plurality of perimeter frame segments. Each of the plurality of perimeter frame segments has a panel side portion and an opposing body perimeter side portion. The body perimeter side portion of each of the plurality of perimeter frame segments is formed as a single layer. Each of the plurality of perimeter frame segments is positioned within the gap defined between the panel perimeter and the body perimeter with the panel side portion positioned adjacent to the panel and the body perimeter side portion positioned at adjacent to at least one of the side walls and the end walls of the body. Each of the plurality of perimeter frame segments is secured to the panel and at least one of the side walls and the end walls of the body.

In another form thereof, the present invention provides a barge for supporting construction equipment in a body of water. The barge includes a body having a rectilinear configuration with two substantially vertical parallel side walls and two substantially vertical parallel end walls. The side walls and the end walls cooperate to define a body perimeter having a body area. The body has a top support structure at least partially defining a top surface of the body forming a deck of the barge and a bottom support structure at least partially defining a bottom surface of the body forming a bottom of the barge. The top support structure includes a plurality of elongate sections secured to one another to form a panel. Each of the plurality of elongate sections includes at least one tubular channel and has a maximum thickness. The panel defines a panel perimeter having a panel area. The panel area is less than the body area, wherein the panel is positioned within the body perimeter and a perimeter gap is formed between the panel perimeter and the body perimeter. The top support structure also includes a plurality of perimeter frame segments having a panel side portion and an opposing body perimeter portion. The body perimeter portion of each of the plurality of perimeter frame segments has a thickness that is less than the maximum thickness of the elongate sections. Each of the plurality of perimeter frame segments is positioned within the perimeter gap defined between the panel perimeter and the body perimeter with the panel side portion of the segments positioned adjacent to the panel and the body perimeter side portion of the segments positioned adjacent to at least one of the side walls and the end walls of the body. Each of the plurality of perimeter frame segments is secured to the panel and at least one of the side walls and the end walls of the body.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION

Figure 1:
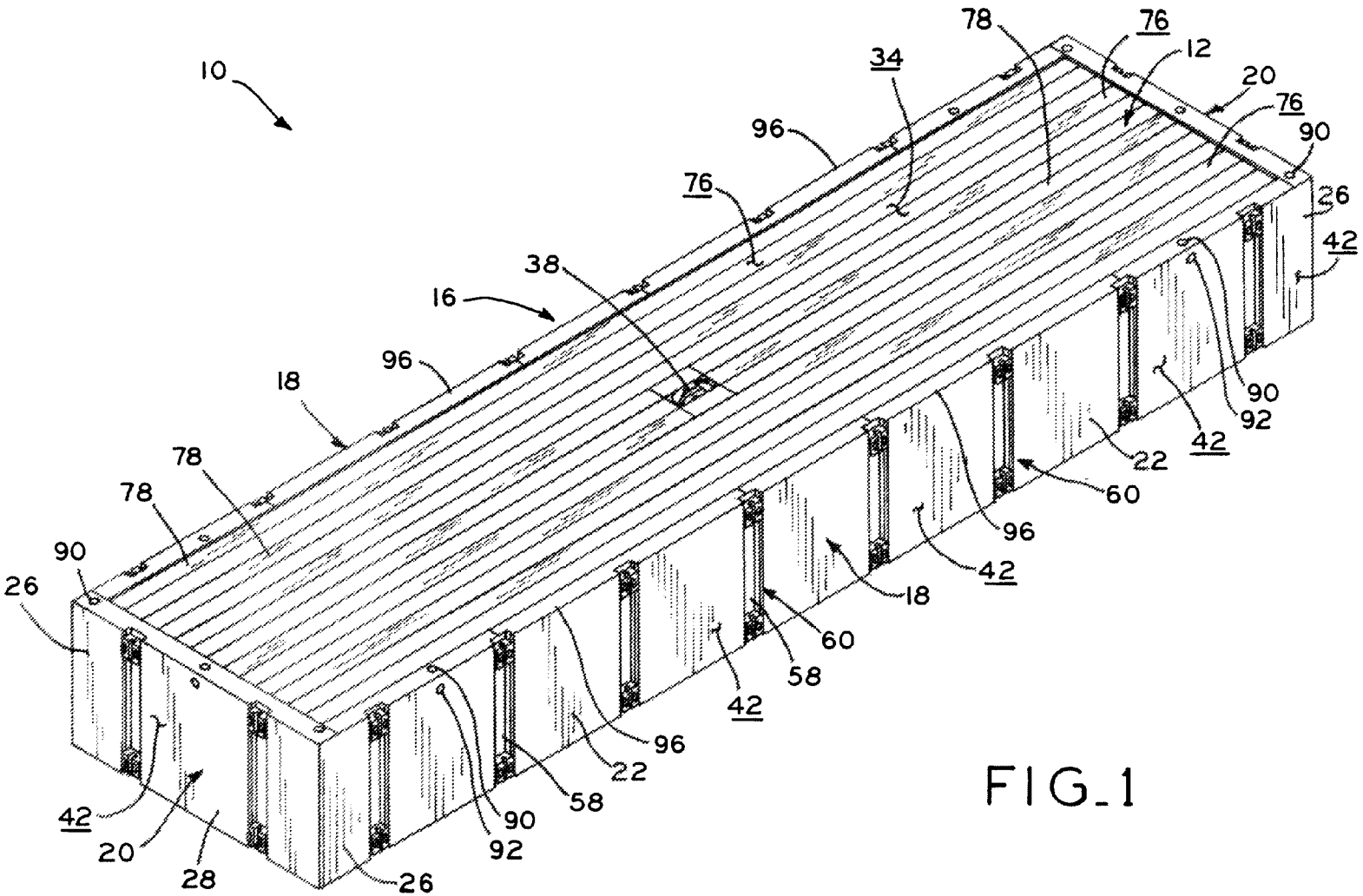
FIG. 1 is a perspective view of an exemplary embodiment of a barge manufactured in accordance with the teachings of the present invention.

Referring to FIG. 1, construction barge 10 is shown. Barge 10 includes top and bottom panels 12, 14, perimeter frame system 16, opposing side walls 18, and opposing end walls 20. Side walls 18 extend vertically and are positioned substantially parallel to one another. Side walls 18 are formed by side panels 22, support assemblies 24, and corner panels 26, as described in detail below. End walls 20 also extend vertically and are substantially parallel with one another and substantially perpendicular to side walls 18. End walls 20 are formed from end panels 28, U-channel segments 30, and corner panels 26, as described in detail below. Side walls 18 and end walls 20 cooperate with one another to define the perimeter of barge 10. Top and bottom panels 12, 14 and perimeter frame system 16 cooperate with one another to define deck 34 and opposing bottom surface 36, respectively, of barge 10. In exemplary embodiment, barge 10 also includes lifting eye assembly 38 that provides a connection and support point at which barge 10 may be lifted by a crane or other heavy machinery and positioned within or removed from a body of water in a known manner.

Figure 3:
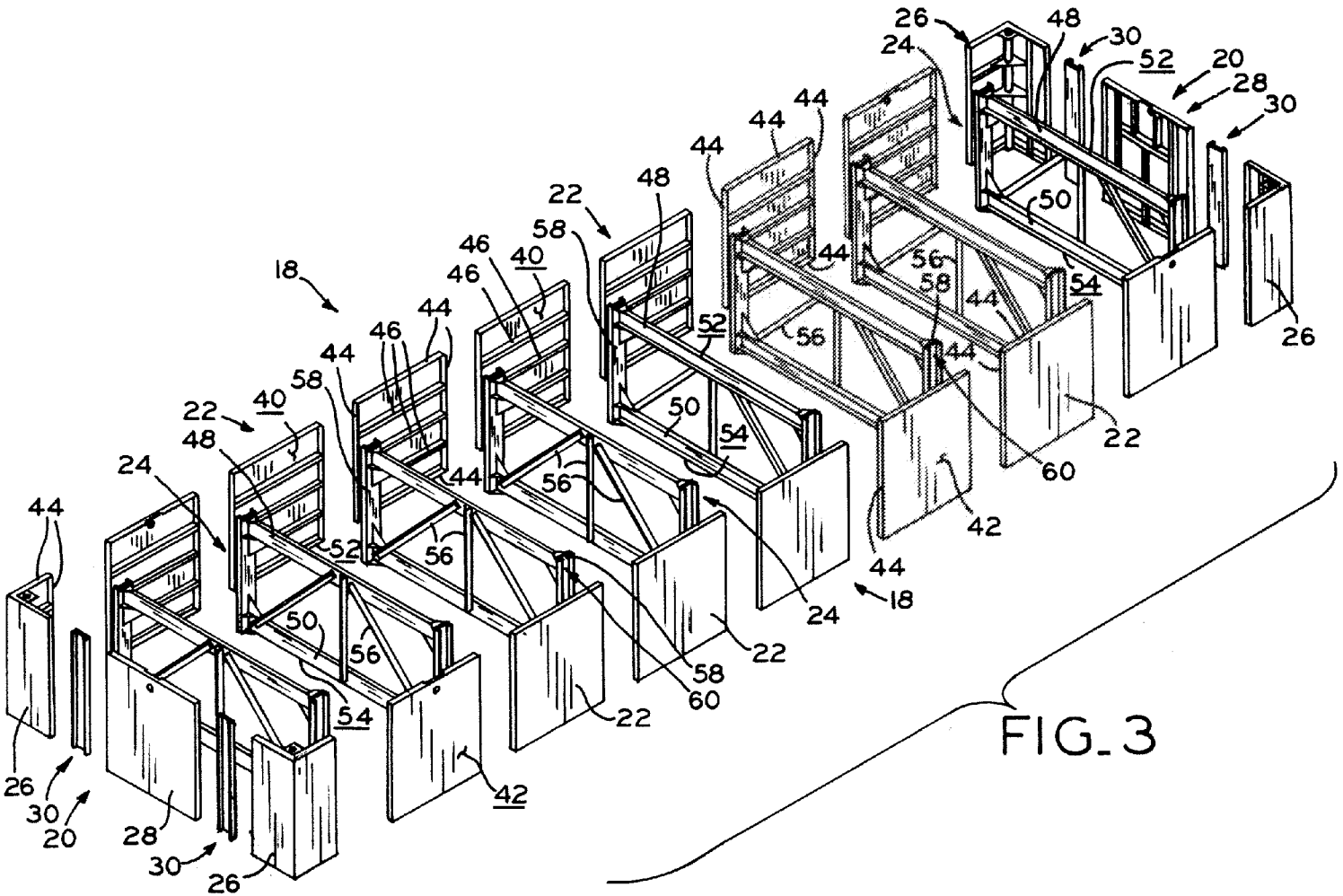
FIG. 3 is an exploded, perspective view of the support structure of the barge of FIG. 1.
Figure 15:
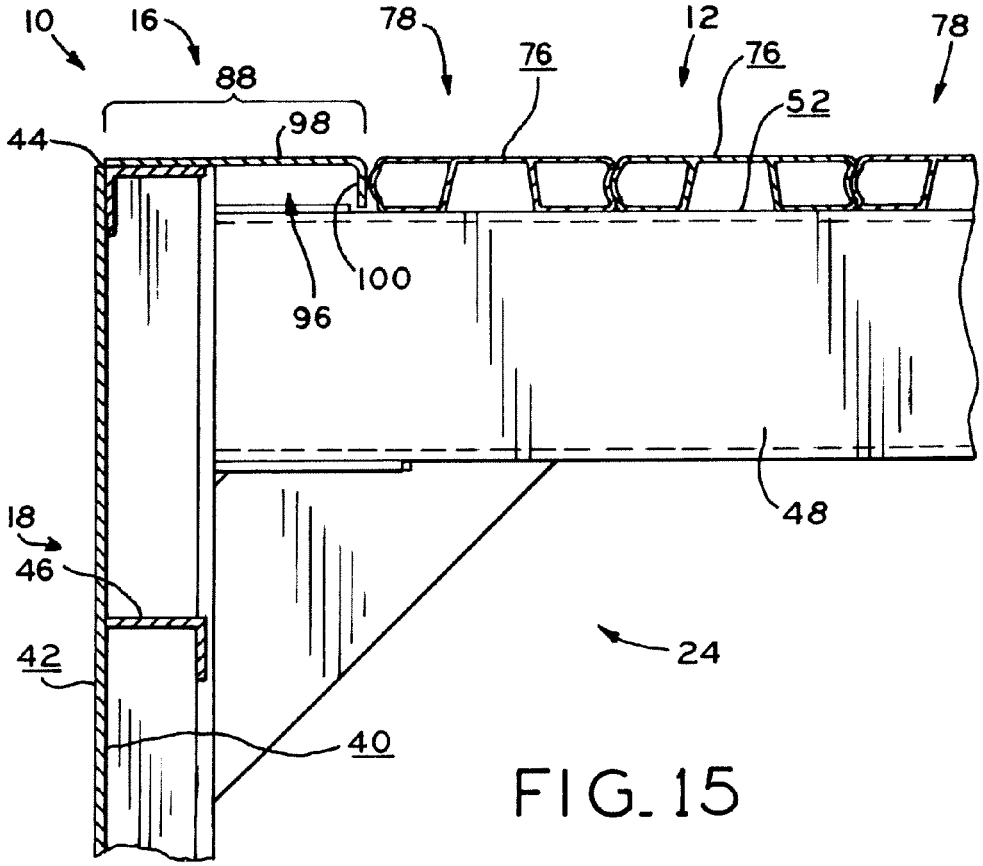
FIG. 15 is an enlarged, cross-sectional view of a corner of the barge shown in FIG. 14.

As indicated above, side walls 18 are formed from side panels 22, support assemblies 24 (FIG. 3), and corner panels 26. Each of side panels 22 and corner panels 26 includes interior surfaces 40, exterior surfaces 42, and flanges 44 (FIG. 15) that extend along each side of the panels in a direction substantially perpendicular to surfaces 40, 42 of panels 24, 26. In one exemplary embodiment, flanges 44 are formed by welding pieces of sheet metal to panels 24, 26. In another exemplary embodiment, flanges 44 are formed by cutting and bending panels 24, 26. Flanges 44 provide connection points and/or support surfaces for additional components of barge 10. In addition to flanges 44, bracing structure, such as cross braces 46, may be provided. Cross braces 46 extend along interior surface 40 of each of side panels 22 and corner panels 26. As shown in FIG. 3, cross braces 46 extend between opposing flanges 44 and are secured thereto, such as by welding. The addition of cross braces 46 provides additional structural rigidity to side panels 22 and corner panels 26.

Figure 4:
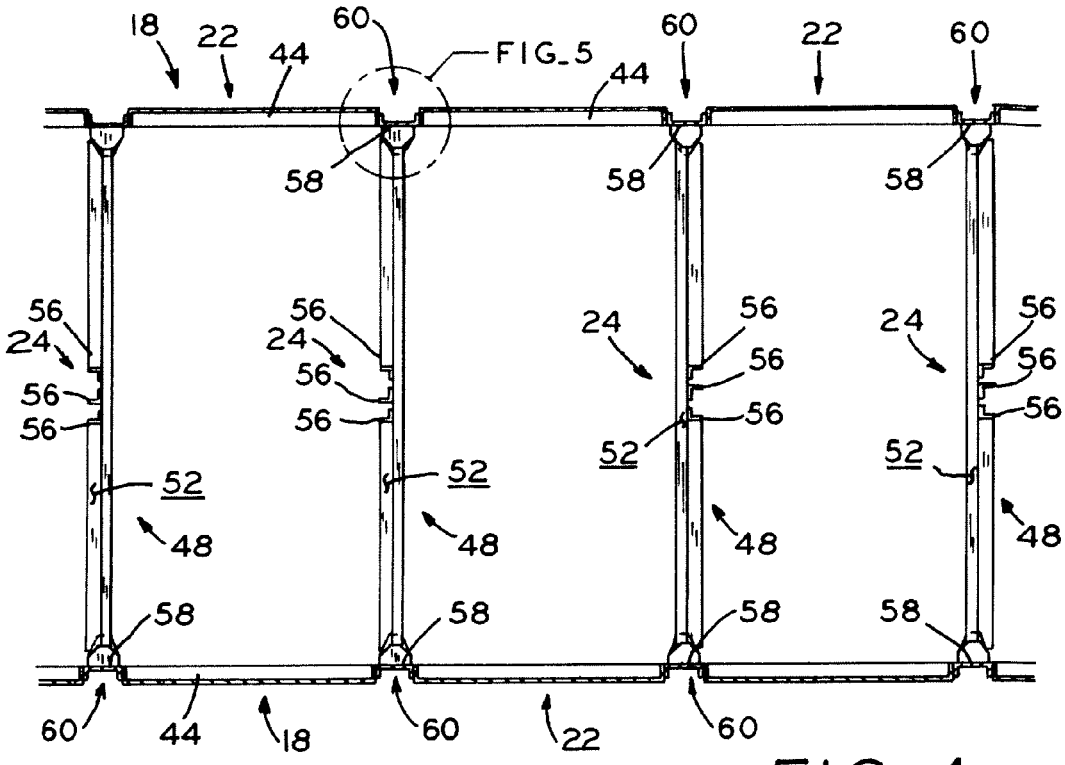
FIG. 4 is a fragmentary, plan view of the support structure of FIG. 3.
Figure 5:
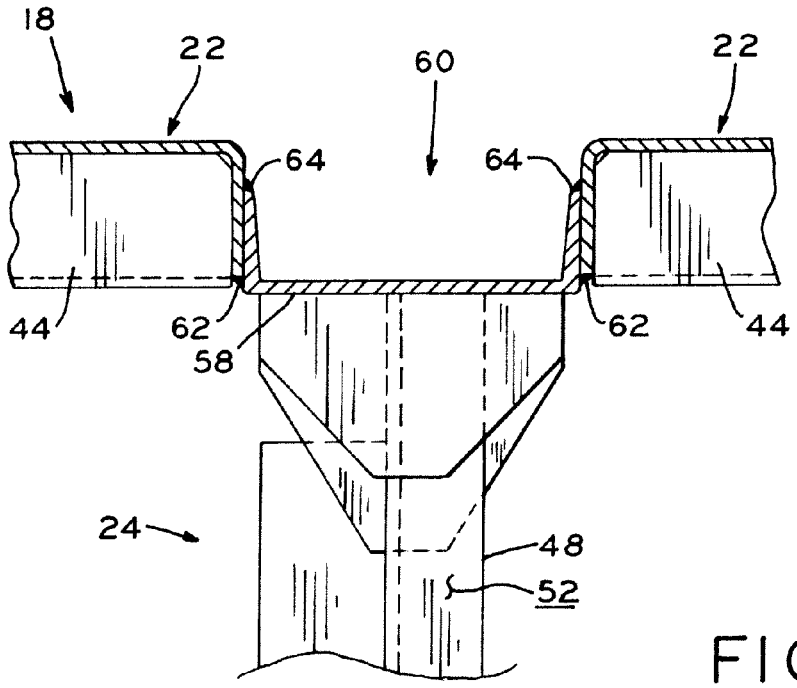
FIG. 5 is an enlarged, fragmentary view of a portion of the support structure of FIG. 4 taken at the dashed circle of FIG. 4.
Figure 14:
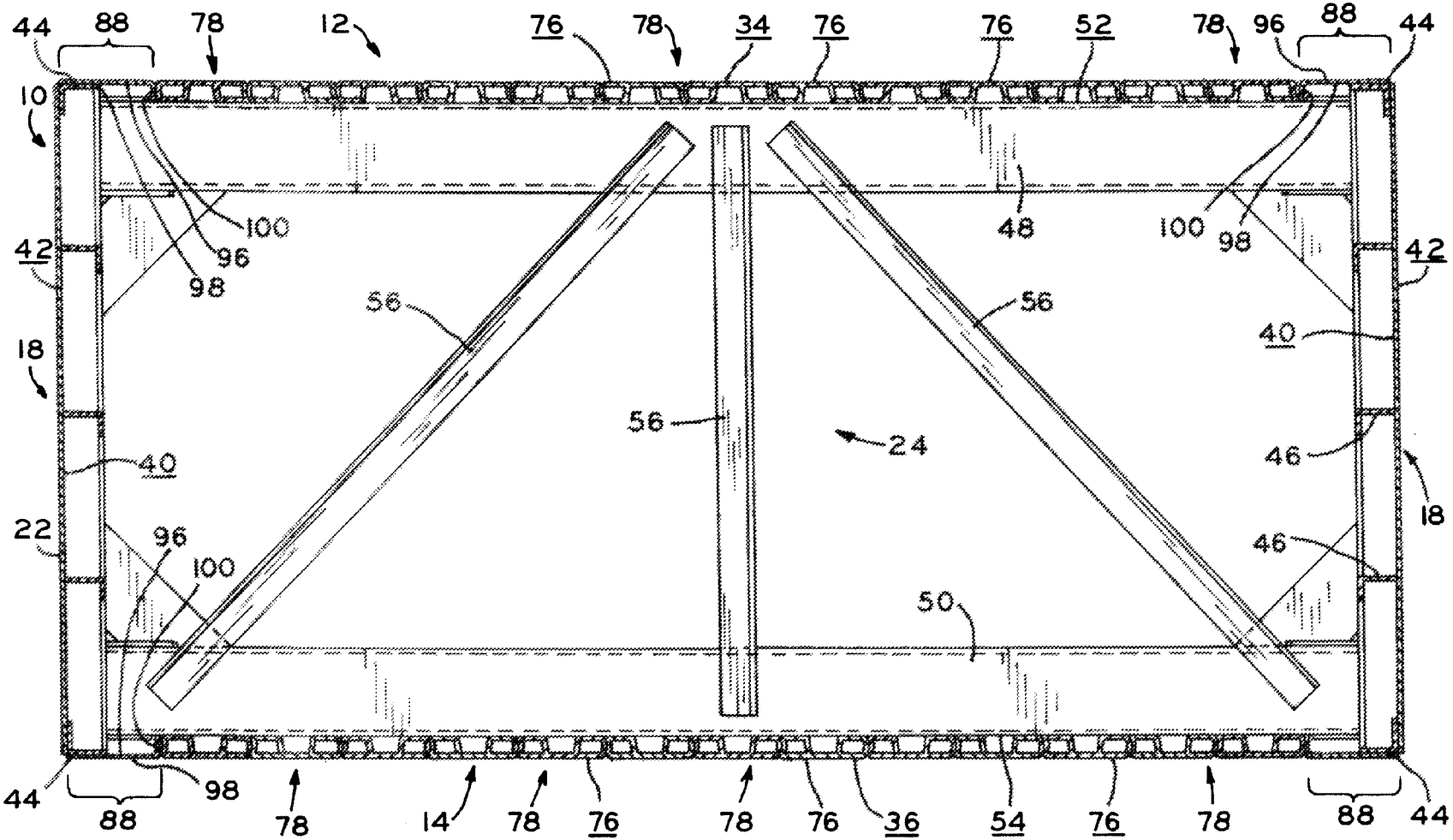
FIG. 14 is a cross-sectional view of the barge of FIG. 1 taken in a direction substantially perpendicular to the longitudinal axis of the barge of FIG. 1.

As indicated above, support assemblies 24 cooperate with side panels 22 and corner panels 26 to form side walls 18 of barge 10. Referring to FIGS. 3-5, a plurality of support assemblies 24 are shown. Support assemblies 24 each include a pair of opposing, horizontal cross members 48, 50 that define upper and lower support surfaces 52, 54, respectively. Upper and lower support surfaces 52, 54 provide for the support and securement of top and bottom panels 12, 14, as described in detail below and shown in FIG. 14. Referring to FIGS. 3 and 14, brace members 56 extend between cross members 48, 50 and provide additional structural support to cross members 48, 50 and support assemblies 24. U-channel segments 58 extend horizontally between opposing cross members 48, 50 at opposing ends of cross members 48, 50. U-channel segments 58 define recesses 60 that may receive connection components for connecting adjacent barges to one another, as described in detail below. Additionally, U-channel segments 58 cooperate with side panels 22 and corner panels 26 to define side walls 18 of barge 10 and position recesses 60 along the perimeter of barge 10.

In order to secure side panels 22, corner panels 26, and support assemblies 24 together to define side walls 18 of barge 10, a pair of support assemblies 24 is aligned substantially parallel with one another. Then, one of side panels 22 is positioned between the adjacent support assemblies 24 and aligned with exterior surface 42 extending perpendicular to support assemblies 24. Flanges 44 of side panels 22 are then secured to the edges of U-channel segments 58. Referring to FIG. 5, flanges 44 may be welded to U-channel segments 58 at welds 62, 64. The process is then repeated by adding another side panel 22 and another support assembly 24 and securing the side panel 22 to one of the previous support assemblies 24 and the newly added support assembly 24. This process may be repeated until the desired number of side panels 22 have been secured between adjacent support assemblies 24. For example, additional side panels 22 and support assemblies 24 may be added to increase the overall length of barge 10. Similarly, side panels 22 and support assemblies 24 may be removed to decrease the overall length of barge 10.

Figure 2:
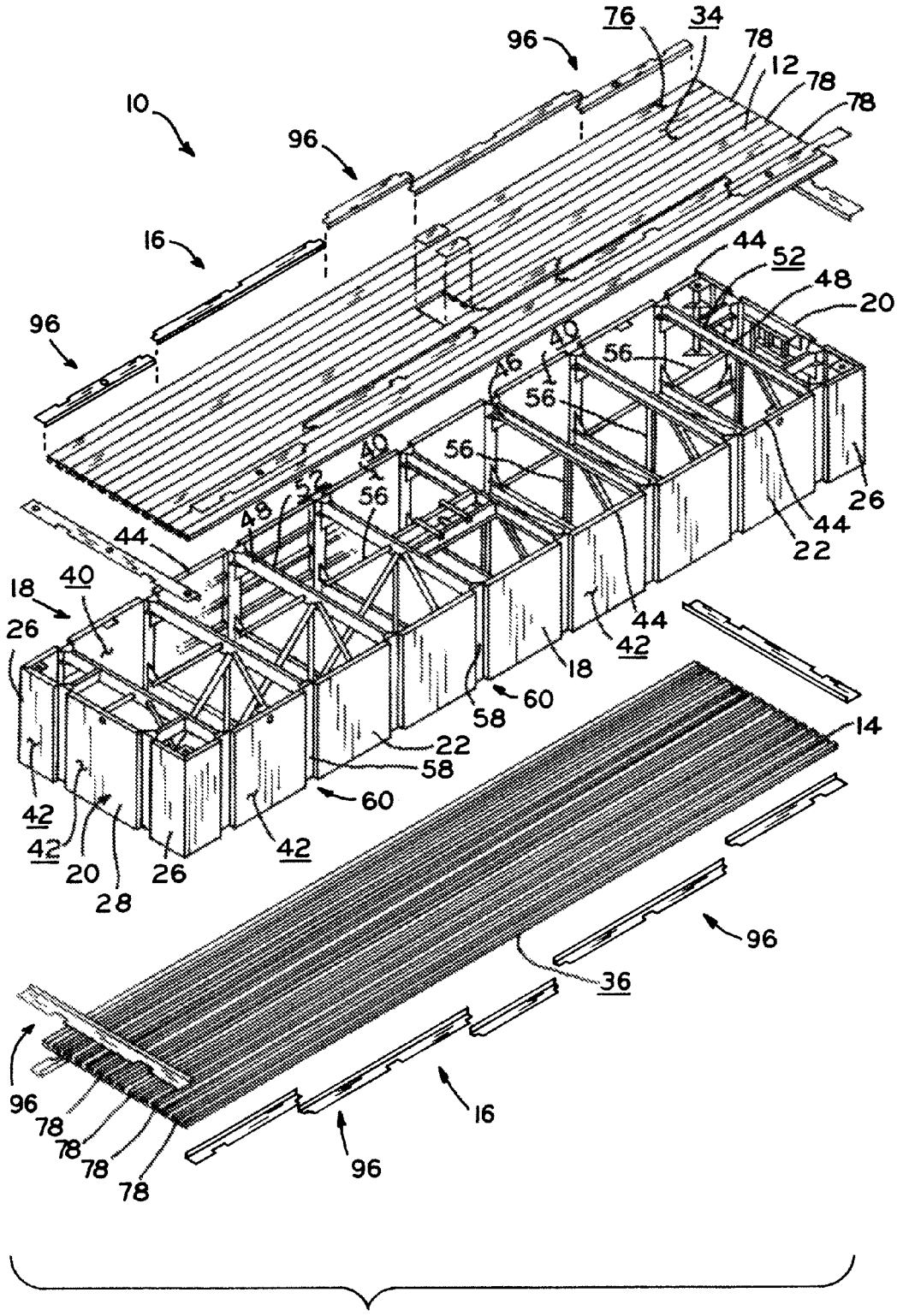
FIG. 2 is an exploded perspective view of the barge of FIG. 1.

In order to add corner panels 26 and from the transition from side walls 18 to end walls 20, corner panels 26 are positioned on opposing sides of and at opposing ends of the support structure. Flanges 44 of corner panels 26 are secured to opposing, terminal support assemblies 24. Specifically, corner panels 26 are secured to U-channel segments 58 of the opposing, terminal support assemblies and function to define each of the four corners of barge 10. In one exemplary embodiment, corner panels 26 are secured to the terminal support assemblies by welding. Stated another way, for the beginning and ending support assemblies 24 at the opposing ends of barge 10, side panels 22 are secured to only one side thereof. The opposing sides of U-channel segments 58 of the beginning and ending support assemblies 24 at the opposing ends of barge 10 are secured to flanges 44 of corner panels 26, as shown in FIGS. 2 and 3.

As indicated above, corner panels 26 also cooperate with end panels 28 and individual U-channel segments 30 to define end wall 20. As shown in FIGS. 2 and 3, end panels 28 are substantially similar to side panels 22 and corresponding reference numerals have been used to identify corresponding parts therebetween. Referring to FIGS. 2 and 3, U-channel segments 30 are positioned to extend vertically between adjacent sides of corner panels 26 and end panel 28. As shown, one of U-channel segments 30 is secured to the portion of each corner panel 26 defining a part of end wall 20. Specifically, one of U-channel segments 30 is secured to one of flanges 44 of each corner panel 26, such as by welding. End panels 28 are then secured between U-channel segments 30 at one of flanges 44, such as by welding. In other embodiments, additional end panels 28 and U-channel segments 30 may be added to increase the width of barge 10.

As indicated above, side walls 18 and end walls 20 cooperate to define the perimeter of barge 10. The area within the top barge perimeter defined by side walls 18 and end walls 20 and extending along a plane incorporating upper support surfaces 52 of cross members 48 is the top barge area. Similarly, the area within the bottom barge perimeter defined by side walls 18 and end walls 20 and extending along a plane incorporating lower support surface 54 of cross members 50 is the bottom barge area.

Figure 6:
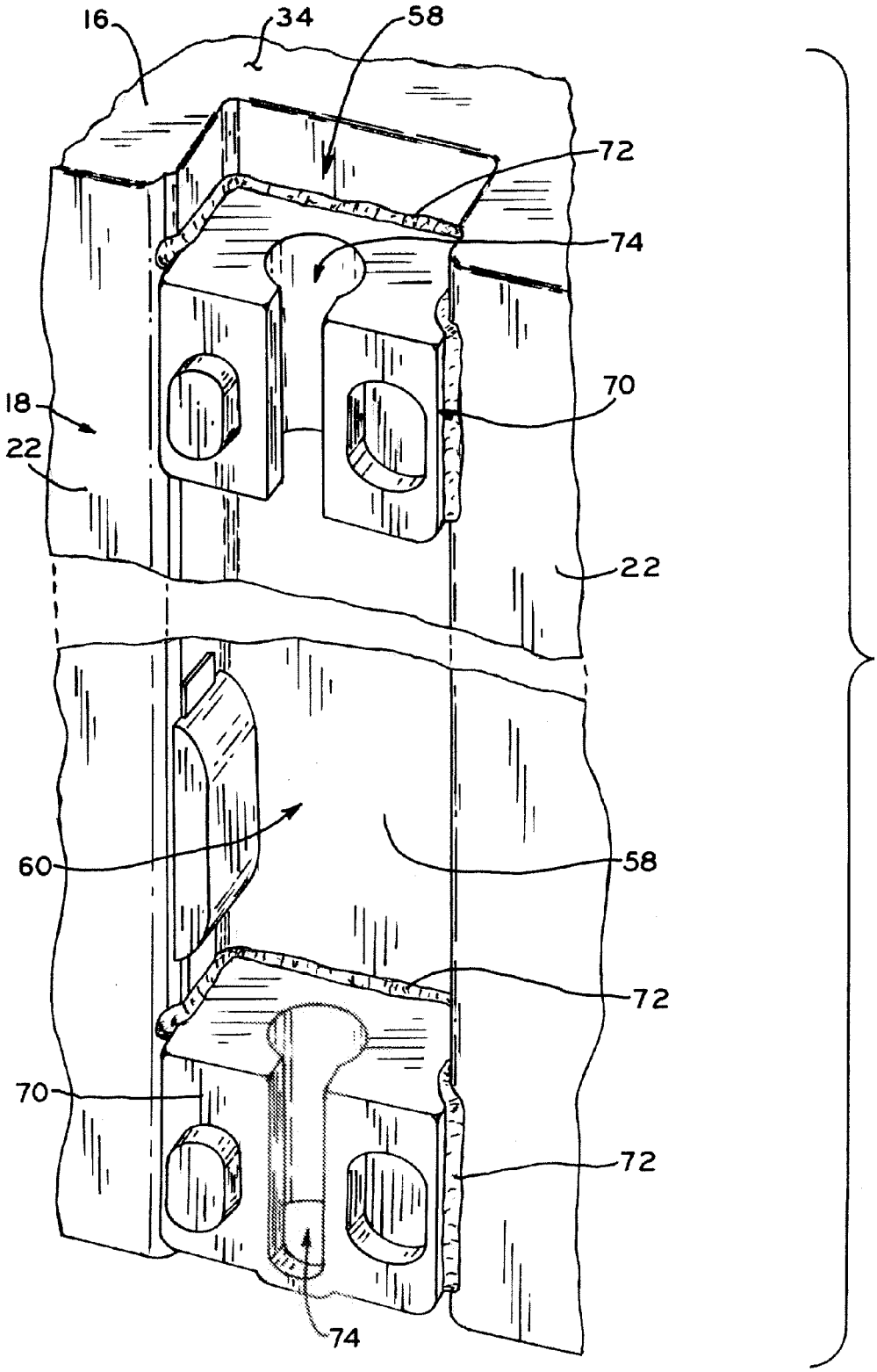
FIG. 6 is a fragmentary, perspective view of a recess formed in the perimeter of the barge of FIG. 1 and further depicting barge connectors positioned therein.
Figure 7:
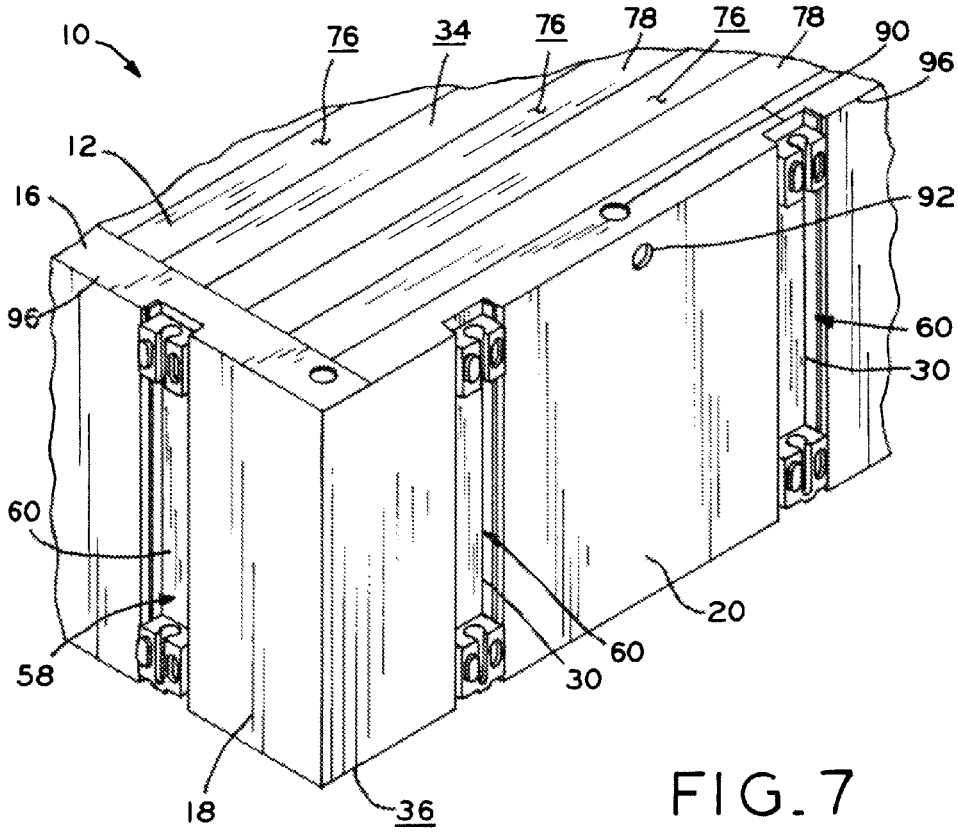
FIG. 7 is a fragmentary, perspective view of one of the corners of the barge of FIG. 1.

Referring to FIG. 6, with side walls 18 and end walls 20 of barge 10 formed, connector components that are used to secure barge 10 to an adjacent barge, such as components 70 of a Rendrag® type connector, may be positioned within recesses 60 defined by U-channel segments 30, 58. In one exemplary embodiment, components 70 are secured to U-channel segments 30, 58 by welding at welds 72. Components 70 have substantially C-shaped openings 74 extending therethrough. A pair of interconnected rods (not shown) that are sized for receipt within openings 74 are used to connected adjacent barges 10 to one another. Specifically, the rods are sized such that the longitudinal axis of rods may be aligned with the longitudinal axis of C-shaped openings 74 and translated therethrough. The rods may be advanced into a position in which they are captured by the wall defining C-shaped openings 74, as the rods are sized such that they cannot pass through the gap defined by C-shaped openings 74. By passing a first one of the rods through components 70 on a first barge 10 and a second one of the rods through components on a second barge 10, the barges 10 are secured together at components 70 in a known manner. By connecting a plurality of adjacent barges 10, the support surface available for construction or other heavy equipment can be expanded.

Figure 9:
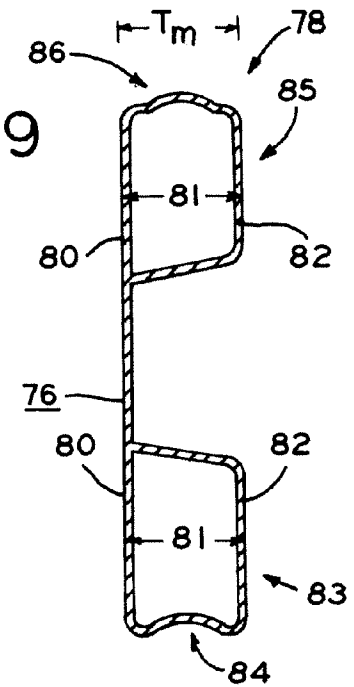
FIG. 9 is a cross-section of the material of FIG. 8 taken along line 9-9 of FIG. 8.
Figure 8:
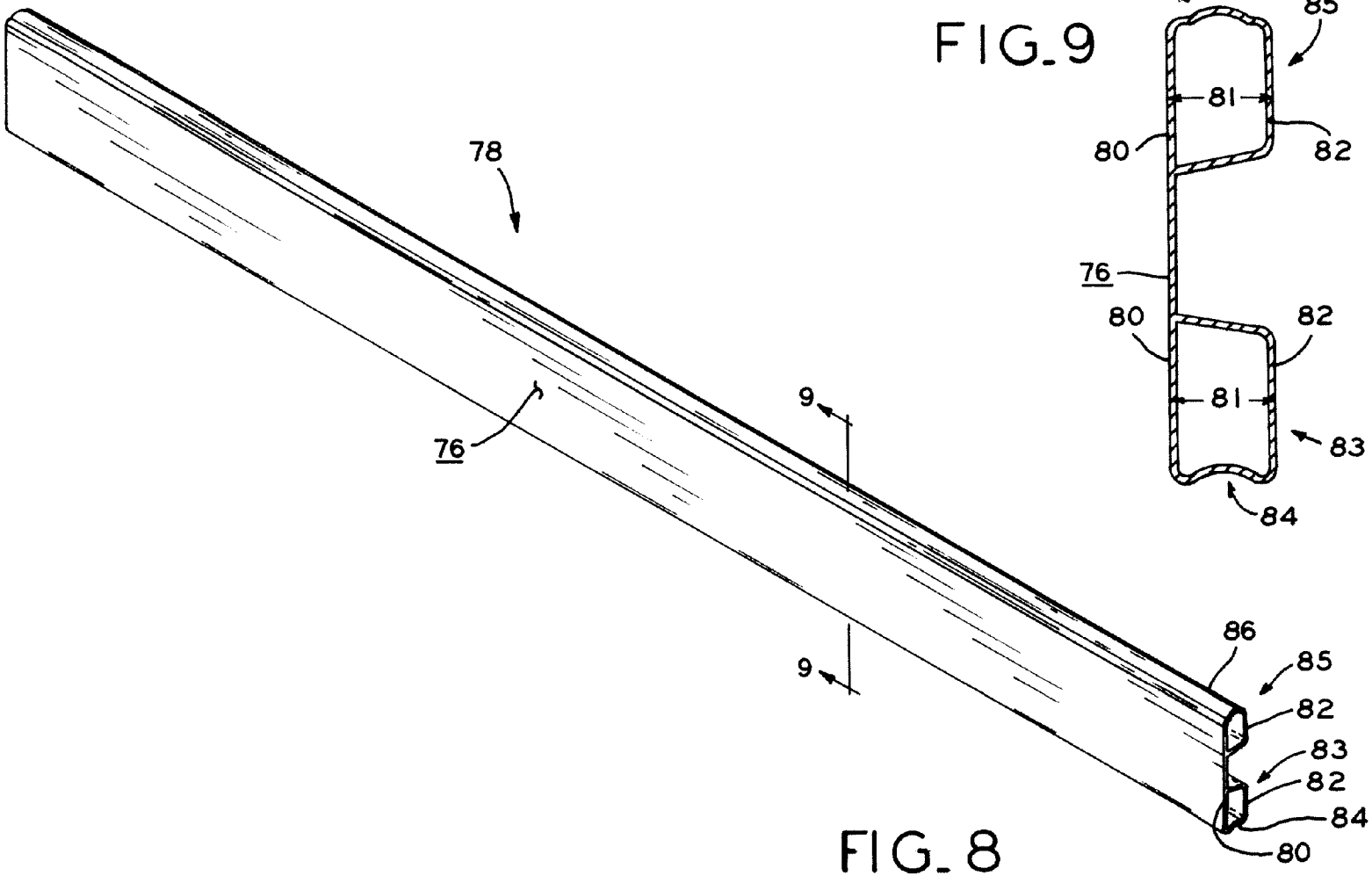
FIG. 8 is a perspective view of an individual section of material used to form a support surface of the barge of FIG. 1.

Referring to FIG. 2, barge 10 includes a pair of opposing top and bottom panels 12, 14, which at least partially define the opposing top and bottom surfaces of barge 10. In one exemplary embodiment, the surfaces of panels 12, 14 are at least partially defined by top surfaces 76 of individual elongate sections 78, as shown in FIGS. 8 and 9. As described in detail below, a plurality of individual elongate sections 78 are secured to one another to form top and bottom panels 12, 14, as shown in FIGS. 1 and 2.

Figure 10:
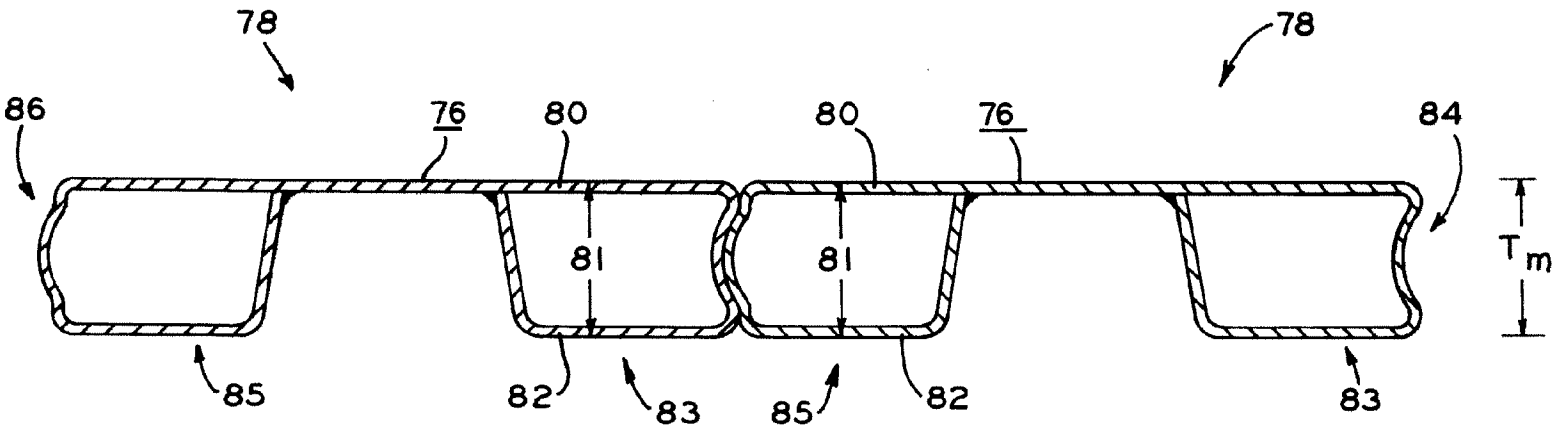
FIG. 10 is a cross-sectional view of two individual sections of the support material of FIG. 8 secured to one another to define a portion of the support surface of the barge of FIG. 1.

Referring to FIGS. 8 and 9, each elongate section 78 is formed with a pair of tubular channels 83, 85. Each section 78 includes substantially planar first layer 80 that defines top surface 76. Each section 78 also includes substantially planar second layer 82 spaced from first layer 80. Gap 81 is defined between first and second layers 80, 82 and separates first and second layers 80, 82 from one another. Additionally, each individual elongate section 78 has a maximum thickness $T_m$. In the embodiment shown in FIGS. 8 and 9, maximum thickness $T_m$ extends from first layer 80 to second layer 82. In one exemplary embodiment, a first side of each section 78 includes recess 84 and a second, opposing side of each section 78 includes projection 86. Recesses 84 and projections 86 may be aligned with each other as shown in FIG. 10 to facilitate the connection of individual sections to one another. Specifically, a first one of sections 78 is aligned with projection 86 received within recess 84 of a second one of sections 78. Once in the position shown in FIG. 10, the aligned sections 78 may be secured to one another, such as by welding. In order to form top and bottom panels 12, 14, a plurality of elongate sections 78 are secured to one another, such as in the manner described above, until the desired width and length of panels 12, 14 is reached.

Referring to FIGS. 8 and 9, each individual elongate section 78 is roll formed. Sections 78 may be formed from hot rolled steel or from steel that is hot rolled, pickled, and oiled.

Elongate sections 78 manufactured by roll forming are commercially available from Roll Form Group of Mississauga, Ontario. However, other manufacturing processes or techniques may be used to form elongate sections 78, such as extrusion. By forming top and bottom panels 12, 14 using elongate sections 78 having the shape shown herein, panels 12, 14 and barge 10 are capable of supporting a substantially greater amount of weight than a traditional construction barge. For example, when panels 12, 14 are formed from sections 78, barge 10 has a point load capacity as high as 20,000 pounds per square foot, while a support surface of barges made in accordance with traditional techniques have a point load capacity of 1,500 pounds per square foot.

Once formed, top surfaces 76 of sections 78 that cooperate to form top panel 12 define a top panel perimeter having a top panel area. Similarly, top surfaces 76 of sections 78 that cooperate to form bottom panel 14 define a bottom panel perimeter having a bottom panel area. The top panel perimeter and the resulting top panel area are less than the top barge perimeter and the top barge area, respectively, of barge 10 as described in detail above. Similarly, the bottom panel perimeter and the resulting bottom panel area are less than the bottom barge perimeter and the bottom barge area, respectively, of barge 10 as described in detail above. Additionally, panels 12, 14 are sized for receipt within top and bottom barge perimeters, respectively. In one exemplary embodiment, the bottom panel area is equal to the top panel area. Alternatively, in other exemplary embodiments, the bottom panel area may be greater than or less than the top panel area.

Top and bottom panels 12, 14 are positioned on and secured to upper and lower support surfaces 52, 54 of cross members 48, 50 of support assemblies 24. In exemplary embodiments, top and bottom panels 12, 14 are secured to upper and lower support surfaces 52, 54 by welding. Due to the decreased area of top and bottom panels 12, 14 relative to the top and bottom barge areas, respectively, gap 88 (FIGS. 12 and 14) is formed between the top and bottom perimeters of barge 10 and the outer edges of panels 12, 14, respectively.

In order to close gap 88 and ensure that barge 10 is watertight, additional sections 78 could be positioned on cross members 58, 50 of support assemblies 24 and secured thereto. However, in order to conform the added sections 78 to the perimeter of barge 10, sections 78 would have to be machined and/or modified, such as by plasma cutting, to accommodate recesses 60 defined by U-channel segments 30, 58 and/or to form first openings 90, shown in FIG. 1, that cooperate with second openings 92 in side panels 22 to define cable thimbles. As indicated above, the ability to machine and/or otherwise modify elongate sections 78 is time consuming, difficult, and expensive. Specifically, due to the large maximum thickness $T_m$ of sections 78 in the area of tubular channels 83, 85, the amount of material that must be modified on the opposing sides of sections 78 is extremely large. Additionally, depending on the necessary modification, both first layer 80 and second layer 82 of sections 78 may have to be modified. This would make it difficult to maintain the water tightness of barge 10.

Figure 11:
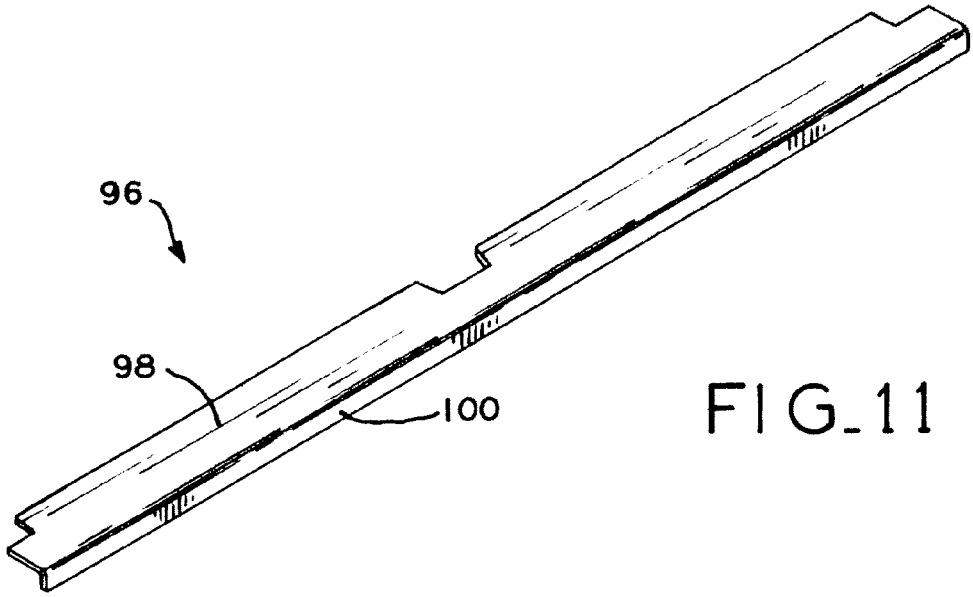
FIG. 11 is a perspective view of a perimeter frame segment of the barge of FIG. 1.
Figure 12:
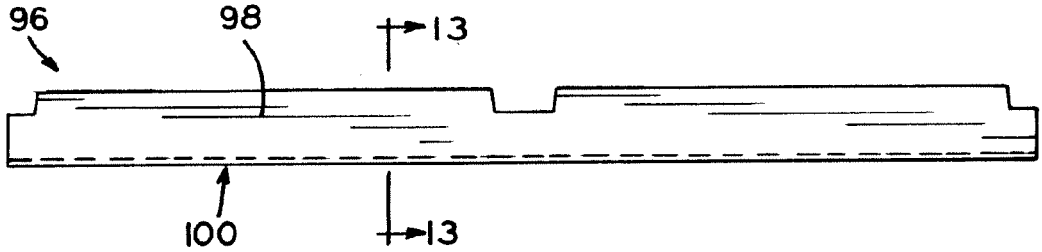
FIG. 12 is a plan view of the perimeter frame segment of FIG. 11.
Figure 13:
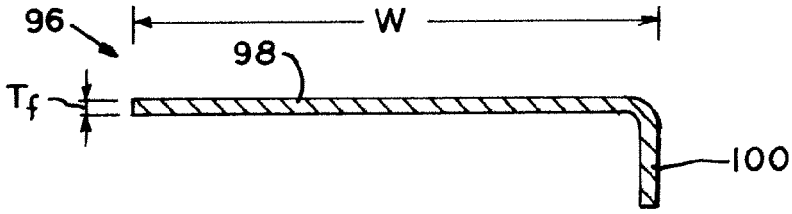
FIG. 13 is a cross-sectional view of the perimeter frame segment of FIG. 12 taken along line 13-13 of FIG. 12.

In accordance with the present invention, rather than providing additional sections 78 and modifying the same to close gap 88 between top and bottom panels 12, 14 and the top and bottom barge perimeter, respectively, perimeter frame system 16 (FIGS. 1 and 2) is used. Referring to FIGS. 11-13, individual perimeter frame segment 96 is shown. Perimeter frame segment 96 has a substantially L-shaped cross-section, as shown in FIG. 13, including barge perimeter portion 98 and panel side portion 100. As shown in FIG. 13, barge perimeter portion 98 preferably defines the widest portion of the L-shape, while panel side portion 100 defines the narrowest portion of the L-shape.

Barge perimeter portion 98 will have a width W (FIG. 13) sufficient to span gap 88 (FIGS. 14 and 15) between the perimeter of panels 12, 14 and the top and bottom barge perimeter. As shown in FIGS. 11-13, each perimeter frame segment 96 may include cutouts 102 that have been cut or otherwise machined into each perimeter frame segment 96 that are sized to accommodate deviations in the top and bottom perimeter of barge 10. For example, Cutouts 102 may be sized to accommodate recesses 60 of U-channel segments 30, 58 (FIG. 3).

Additionally, in exemplary embodiments, barge perimeter portion 98 has a simpler cross-section than sections 78 and has a thickness $T_f$ (FIG. 13) that is less than the maximum thickness $T_m$ of elongate sections 78 (FIG. 9). As a result, barge perimeter portion 98 of each individual frame segment 96 may be modified more readily than elongate sections 78 that form panels 12, 14, as less material must be cut through or otherwise machined. This allows for the modification and/or machining of barge perimeter portion 98 to accommodate recesses and other variations in the perimeter of barge 10 with decreased difficulty, time, and expense. In one exemplary embodiment, barge perimeter portion 98 is formed from a single layer, i.e., there is no gap formed between opposing sides of barge perimeter portion 98. This also allows for barge perimeter portion 98 to be more readily modified to accommodate the perimeter of barge 10. For example, the need to separately align and perform independent cutting or other machining operations on multiple layers of material is eliminated.

Further, barge perimeter portion 98 can be readily secured to the perimeter of barge 10 by welding a single layer of material to the components defining the perimeter of barge 10. In contrast, if elongate sections 78 were modified to accommodate the perimeter of barge 10, multiple layers of material having a complex cross-section would have to be precisely machined and secured, such as by welding, to the perimeter of barge 10. Additionally, each of these individual welds for each of the layers of material would have to be checked to ensure that the water tightness of barge 10 is maintained. However, because barge perimeter portion 98 includes only a single layer of material, a single connection to the perimeter of barge 10 is made for each perimeter frame segment 96. This single connection can be easily formed by welding and can be readily checked for water tightness. As a result, the water tightness of the barge 10 can be ensured in a much quicker and less expensive manner.

In order to complete perimeter frame system 16, each perimeter frame segment 96 is secured to one of panels 12, 14 and barge 10. Referring to top panel 12 and the top barge perimeter defined by side walls 18 and end walls 20, as described in detail above, each perimeter frame segment is aligned with cutouts 102 positioned around recesses 60 with barge perimeter portions 98 in contact with flanges 44 of at least one of side walls 18 and end walls 20 at the top barge perimeter. Additionally, barge perimeter portions 98 are aligned to extend in a direction substantially perpendicular to side walls 18 and end walls 20 and substantially parallel to the top surface of top panel 12. In this position, panel side portion 100 is in contact with the side of elongate sections 78 defining a portion of the perimeter of top panel 12. Additionally, panel side portions 100 are positioned to extend along the perimeter of top panel 12 in a direction substantially perpendicular to the top surface of top panel 12. Once in this position, perimeter frame segment 96 is secure to flanges 44 of at least one of side walls 18 and end walls 20 at the top barge perimeter and is secured to elongate sections 78 at the perimeter of top panel 12, such as by welding. This process is then repeated for each individual perimeter frame segment 96 until perimeter frame system 16 is completed. Then, the ends of individual perimeter frame segments 96 that contact one another may be secured together, such as by welding, resulting in gap 88 being completely sealed in a watertight manner. The process may then be repeated to fill any gap that may be formed between the bottom barge perimeter and bottom panel 14.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A barge for supporting construction equipment in a body of water, comprising:

a body having a rectilinear configuration with two substantially vertical parallel side walls and two end walls, said side walls and said end walls cooperating to define a body perimeter having a body area, said body having a top support structure at least partially defining a top surface of said body forming a deck of the barge and a bottom support structure at least partially defining a bottom surface of said body forming the body of the barge, said top support structure comprising:

a plurality of elongate sections secured to one another to form a panel lying in a generally horizontal plane, each of said plurality of elongate sections comprising at least one elongate tubular channel extending in said plane, said panel having lateral edges defining a panel perimeter having a panel area, said panel area being less than said body area, wherein said panel is positioned within said body perimeter and spaced generally horizontally inwardly of said body perimeter such that a perimeter gap is formed between said panel perimeter and said body perimeter; and a plurality of perimeter frame segments having a panel side portion and an opposing body perimeter portion, each of said plurality of perimeter frame segments positioned within said perimeter gap defined between said panel perimeter and said body perimeter with said panel side portion of said segments positioned adjacent to said panel perimeter and said body perimeter side portion of said segments positioned adjacent to at least one of said side walls and said end walls of said body, each of said plurality of perimeter frame segments secured to said panel and at least one of said side walls and said end walls of said body.

2. The barge of claim 1, A barge for supporting construction equipment in a body of water, comprising:

a body having a rectilinear configuration with two substantially vertical parallel side walls and two substantially vertical parallel end walls, said side walls and said end walls cooperating to define a body perimeter having a body area, said body having a top support structure at least partially defining a top surface of said body forming a deck of the barge and a bottom support structure at least partially defining a bottom surface of said body forming the body of the barge, said top support structure comprising:

a plurality of elongate sections secured to one another to form a panel, each of said plurality of elongate sections comprising at least one tubular channel and having a maximum thickness, said panel defining a panel perimeter having a panel area, said panel area being less than said body area, wherein said panel is positioned within said body perimeter and a perimeter gap is formed between said panel perimeter and said body perimeter; and a plurality of perimeter frame segments having a panel side portion and an opposing body perimeter portion, said body perimeter portion of each of said plurality of perimeter frame segments having a thickness less than said maximum thickness of said elongate sections, each of said plurality of perimeter frame segments positioned within said perimeter gap defined between said panel perimeter and said body perimeter with said panel side portion of said segments positioned adjacent to said panel and said body perimeter side portion of said segments positioned adjacent to at least one of said side walls and said end walls of said body, each of said plurality of perimeter frame segments secured to said panel and at least one of said side walls and said end walls of said body;

wherein at least a portion of said side walls and said end walls of said body define recesses and at least a portion of said plurality of perimeter frame segments have cutouts sized to accommodate at least a portion of said recesses.

3. The barge of claim 2, wherein connectors for connecting the barge to another barge in open water are positioned within said recesses.

4. A barge for supporting construction equipment in a body of water, comprising:

a body having a rectilinear configuration with two substantially vertical parallel side walls and two substantially vertical parallel end walls, said side walls and said end walls cooperating to define a body perimeter having a body area, said body having a top support structure at least partially defining a top surface of said body forming a deck of the barge and a bottom support structure at least partially defining a bottom surface of said body forming the body of the barge, said top support structure comprising:

a plurality of elongate sections secured to one another to form a panel, each of said plurality of elongate sections comprising at least one tubular channel and having a maximum thickness, said panel defining a panel perimeter having a panel area, said panel area being less than said body area wherein said panel is positioned within said body perimeter and a perimeter gap is formed between said panel perimeter and said body perimeter; and a plurality of perimeter frame segments having a panel side portion and an opposing body perimeter portion, said body perimeter portion of each of said plurality of perimeter frame segments having a thickness less than said maximum thickness of said elongate sections, each of said plurality of perimeter frame segments positioned within said perimeter gap defined between said panel perimeter and said body perimeter with said panel side portion of said segments positioned adjacent to said panel and said body perimeter side portion of said segments positioned adjacent to at least one of said side walls and said end walls of said body, each of said plurality of perimeter frame segments secured to said panel and at least one of said side walls and said end walls of said body; and a cable thimble defining a channel for receiving a cable therethrough, wherein one of said side walls and said end walls of said body defines a first opening of said channel of said cable thimble and one of said plurality of perimeter frame segments defines a second opening of said channel of said cable thimble.

5. A barge for supporting construction equipment in a body of water, comprising:

a body having a rectilinear configuration with two substantially vertical parallel side walls and two substantially vertical parallel end walls, said side walls and said end walls cooperating to define a body perimeter having a body area, said body having a top support structure at least partially defining a top surface of said body forming a deck of the barge and a bottom support structure at least partially defining a bottom surface of said body forming the body of the barge, said top support structure comprising:

a plurality of elongate sections secured to one another to form a panel, each of said plurality of elongate sections comprising at least one tubular channel and having a maximum thickness, said panel defining a panel perimeter having a panel area, said panel area being less than said body area, wherein said panel is positioned within said body perimeter and a perimeter gap is formed between said panel perimeter and said body perimeter; and a plurality of perimeter frame segments having a panel side portion and an opposing body perimeter portion, said body perimeter portion of each of said plurality of perimeter frame segments having a thickness less than said maximum thickness of said elongate sections, each of said plurality of perimeter frame segments positioned within said perimeter gap defined between said panel perimeter and said body perimeter with said panel side portion of said segments positioned adjacent to said panel and said body perimeter side portion of said segments positioned adjacent to at least one of said side walls and said end walls of said body, each of said plurality of perimeter frame segments secured to said panel and at least one of said side walls and said end walls of said body;

wherein each of said plurality of perimeter frame segments has a substantially L-shaped cross section, wherein said body perimeter side portion of said segments extends in a direction substantially perpendicular to both said side walls and said end walls of said body and said panel side portion of said segments extends in a direction substantially parallel to one of said side walls and said end walls and substantially perpendicular to the other of said side walls and said end walls.

6. The barge of claim 1, further comprising a plurality of side panels and a plurality of support assemblies, each of said plurality of support assemblies having a pair of cross beams and a pair of brace segments extending between said pair of cross beams, said brace segments cooperating with said side panels to define said side walls of said body.

7. A barge for supporting construction equipment in a body of water, comprising:

a body having a rectilinear configuration with two substantially vertical parallel side walls and two end walls, said side walls and said end walls cooperating to define a body perimeter having a body area, said body having a top support structure at least partially defining a top surface of said body forming a deck of the barge and a bottom support structure at least partially defining a bottom surface of said body forming the bottom of the barge, said top support structure comprising:

a plurality of elongate sections secured to one another to form a panel lying in a generally horizontal plane, each of said plurality of elongate sections comprising at least one elongate tubular channel extending in said plane and having a first layer and a second layer, said second layer extending in a direction substantially parallel to said first layer and spaced from said first layer, wherein a gap is defined between said first layer and said second layer, said panel defining a panel perimeter having a panel area, said panel area being less than said body area, wherein said panel is positioned within said body perimeter and spaced generally horizontally inwardly of said body perimeter such that a perimeter gap is formed between said panel perimeter and said body perimeter; and a plurality of perimeter frame segments, each of said plurality of perimeter frame segments having a panel side portion and an opposing body perimeter side portion, said body perimeter side portion of each of said plurality of perimeter frame segments formed as a single layer, each of said plurality of perimeter frame segments positioned within said gap defined between said panel perimeter and said body perimeter with said panel side portion positioned adjacent to said panel perimeter and said body perimeter side portion positioned adjacent to at least one of said side walls and said end walls of said body, each of said plurality of perimeter frame segments secured to said panel and at least one, of said side walls and said end walls of said body.

8. A barge for supporting construction equipment in a body of water, comprising:

a body having a rectilinear configuration with two substantially vertical parallel side walls and two substantially vertical parallel end walls, said side walls and said end walls cooperating to define a body perimeter having a body area, said body having a top support structure at least partially defining a top surface of said body forming a deck of the barge and a bottom support structure at least partially defining a bottom surface of said body forming the bottom of the barge, said top support structure comprising:

a plurality of elongate sections secured to one another to form a panel, each of said plurality of elongate sections comprising at least one tubular channel and having a first layer and a second layer, said second layer extending in a direction substantially parallel to said first layer and spaced from said first layer, wherein a gap is defined between said first layer and said second layer, said panel defining a panel perimeter having a panel area, said panel area being less than said body area, wherein said panel is positioned within said body perimeter and a perimeter gap is formed between said panel perimeter and said body perimeter; and a plurality of perimeter frame segments, each of said plurality of perimeter frame segments having a panel side portion and an opposing body perimeter side portion, said body perimeter side portion of each of said plurality of perimeter frame segments formed as a single layer, each of said plurality of perimeter frame segments positioned within said gap defined between said panel perimeter and said body perimeter with said panel side portion positioned adjacent to said panel and said body perimeter side portion positioned at adjacent to at least one of said side walls and said end walls of said body, each of said plurality of perimeter frame segments secured to said panel and at least one of said side walls and said end walls of said body;

wherein each of said plurality of elongate sections has an elongate section thickness extending between a top surface of said first layer and an opposing bottom surface of said second layer and said body perimeter side portion of each of said plurality of perimeter frame segments has a frame segment thickness that is less than said elongate section thickness.

9. A barge for supporting construction equipment in a body of water, comprising:

a body having a rectilinear configuration with two substantially vertical parallel side walls and two substantially vertical parallel end walls, said side walls and said end walls cooperating to define a body perimeter having a body area, said body having a top support structure at least partially defining a top surface of said body forming a deck of the barge and a bottom support structure at least partially defining a bottom surface of said body forming the bottom of the barge, said top support structure comprising:

a plurality of elongate sections secured to one another to form a panel, each of said plurality of elongate sections comprising at least one tubular channel and having a first layer and a second layer, said second layer extending in a direction substantially parallel to said first layer and spaced from said first layer, wherein a gap is defined between said first layer and said second layer, said panel defining a panel perimeter having a panel area, said panel area being less than said body area, wherein said panel is positioned within said body perimeter and a perimeter gap is formed between said panel perimeter and said body perimeter; and a plurality of perimeter frame segments, each of said plurality of perimeter frame segments having a panel side portion and an opposing body perimeter side portion, said body perimeter side portion of each of said plurality of perimeter frame segments formed as a single layer, each of said plurality of perimeter frame segments positioned within said gap defined between said panel perimeter and said body perimeter with said panel side portion positioned adjacent to said panel and said body perimeter side portion positioned at adjacent to at least one of said side walls and said end walls of said body, each of said plurality of perimeter frame segments secured to said panel and at least one of said side walls and said end walls of said body;

wherein at least a portion of said side walls and said end walls of said body define recesses and at least a portion of said plurality of perimeter frame segments have cutouts sized to accommodate at least a portion of said recesses.

10. The barge of claim 9, wherein connectors for connecting the barge to another barge in open water are positioned within said recesses.

11. A barge for supporting construction equipment in a body of water, comprising:

a body having a rectilinear configuration with two substantially vertical parallel side walls and two substantially vertical parallel end walls, said side walls and said end walls cooperating to define a body perimeter having a body area, said body having a top support structure at least partially defining a top surface of said body forming a deck of the barge and a bottom support structure at least partially defining a bottom surface of said body forming the bottom of the barge, said top support structure comprising:

a plurality of elongate sections secured to one another to form a panel, each of said plurality of elongate sections comprising at least one tubular channel and having a first layer and a second layer, said second layer extending in a direction substantially parallel to said first layer and spaced from said first layer, wherein a gap is defined between said first layer and said second layer, said panel defining a panel perimeter having a panel area, said panel area being less than said body, area, wherein said panel is positioned within said body perimeter and a perimeter Rap is formed between said panel perimeter and said body perimeter; and a plurality of perimeter frame segments, each of said plurality of perimeter frame segments having a panel side portion and an opposing body perimeter side portion, said body perimeter side portion of each of said plurality of perimeter frame segments formed as a single layer, each of said plurality of perimeter frame segments positioned within said gap defined between said panel perimeter and said body perimeter with said panel side portion'positioned adjacent to said panel and said body perimeter side portion positioned at adjacent to at least one of said side walls and said end walls of said body, each of said plurality of perimeter frame segments secured to said panel and at least one of said side walls and said end walls of said body;

wherein each of said plurality of perimeter frame segments has a substantially L-shaped cross section, wherein said body perimeter side portion of said segments extends in a direction substantially perpendicular to both said side'walls and said end walls of said body and said panel side portion of said segments extends in a direction substantially parallel to one of said side walls and said end walls and substantially perpendicular to the other of said side walls and said end walls.

12. The barge of claim 7, further comprising a plurality of side panels and a plurality of support assemblies, each of said plurality of support assemblies having a pair of cross beams and a pair of brace segments extending between said pair of cross beams, said brace segments cooperating with said side, panels to define said side walls of said body.

* * * * *

UNITED STATES PATENT AND TRADEMARK OFFICE

CERTIFICATE OF CORRECTION

PATENT NO. : 8,079,320 B1
APPLICATION NO. : 12/611402
DATED : December 20, 2011
INVENTOR(S) : Suriani It is certified that error appears in the above-identified patent and that said Letters Patent is hereby corrected as shown below:

Column 9, Line 56, delete "The barge of Claim 1,"

Column 12, Line 32, after "one" delete ","

Column 14, Line 26, delete "Rap" and insert --gap--

Column 14, Line 47, after "side" delete ""

Column 14, Line 56, after "side" delete ","

Signed and Sealed this
Twenty-eighth Day of February, 2012

David J. Kappos

David J. Kappos
*Director of the United States Patent and Trademark Office*